US011200821B2

(12) United States Patent
Huang et al.

(10) Patent No.: US 11,200,821 B2
(45) Date of Patent: Dec. 14, 2021

(54) IMAGE PROCESSING CHIP TEST METHOD

(71) Applicant: Realtek Semiconductor Corp., HsinChu (TW)

(72) Inventors: Zong-Da Huang, HsinChu (TW); Ching-Lan Yang, HsinChu (TW)

(73) Assignee: Realtek Semiconductor Corp., HsinChu (TW)

( * ) Notice: Subject to any disclaimer, the term of this patent is extended or adjusted under 35 U.S.C. 154(b) by 0 days.

(21) Appl. No.: 17/037,733

(22) Filed: Sep. 30, 2020

(65) Prior Publication Data

US 2021/0327318 A1 Oct. 21, 2021

(30) Foreign Application Priority Data

Apr. 20, 2020 (TW) ..... 109113177

(51) Int. Cl.
*G09G 3/00* (2006.01)

(52) U.S. Cl.
CPC ..... *G09G 3/006* (2013.01); *G09G 2330/12* (2013.01)

(58) Field of Classification Search
CPC ..... G09G 3/006; G09G 2330/12
See application file for complete search history.

(56) References Cited

U.S. PATENT DOCUMENTS

2006/0233279 A1* 10/2006 Ryder ..... H04L 25/028 375/296

FOREIGN PATENT DOCUMENTS

TW 200703014 1/2007

* cited by examiner

*Primary Examiner* — Mark W Regn
(74) *Attorney, Agent, or Firm* — Winston Hsu

(57) ABSTRACT

An image processing chip test method comprising: controlling a power supply circuit to provide a first operating voltage to an image processing chip comprising a storage device; and when reading written first image data from the storage device, the test device receives a first error detection code corresponding to the first image data and determines whether the first error detection code means an error occurs. If an error occurs, record the first operating voltage as an erroneous operating voltage, and if the error does not occur, provide a second operating voltage to the image processing chip. Also, when the written second image data is read from the storage device, the test device receives a second error detection code corresponding to the second image data and determines whether the second error detection code means an error occurs.

20 Claims, 4 Drawing Sheets

IMAGE PROCESSING CHIP TEST METHOD

BACKGROUND OF THE INVENTION

1. Field of the Invention

The present invention relates to an image processing chip test method, and particularly relates to an image processing chip test method which can automatically test an erroneous operating voltage of an image processing chip.

2. Description of the Prior Art

Conventionally, am operating voltage provided to an image processing chip is manually adjusted when a test of the image processing chip is performed. Also, a display connected to the image processing chip is monitored to see if any problem occurs on the display, such as flashing or image string, to determine whether the operating voltage is proper or not.

However, only serious problems can be found by such method. If the display only has slight problems, the tester may not find the operating voltage is wrong since the image with problems may not obvious or only shows up in a very short time.

SUMMARY OF THE INVENTION

One objective of the present invention is to provide an image chip test method which can automatically and accurately detect an erroneous operating voltage.

Another objective of the present invention is to provide an image chip test system which can automatically and accurately detect an erroneous operating voltage.

One embodiment of the present invention provides an image processing chip test method performed by executing at least one program on a test device, comprising: controlling a power supply circuit to provide a first operating voltage to an image processing chip comprising at least one storage device; writing first image data to the storage device; receiving a first error detection code corresponding to the first image data and determining whether the first error detection code means an error occurs by the test device, while reading the first image data from the storage device; recording the first operating voltage as the erroneous operating voltage, when the first error detection code means the error occurs; and providing a second operating voltage to the image processing chip, writing second image data to the storage device, reading the second image from the storage device, receiving a second error detection code corresponding to the second image data and determining whether the second error detection code means the error occurs, when the first error detection code means that the error does not occur.

Another embodiment of the present invention provides an image processing chip test system, which comprises: a test device; a power supply circuit; and an image processing chip, comprising at least one storage device; wherein the test device controls a power supply circuit to provide a first operating voltage to an image processing chip; wherein the test device receives a first error detection code corresponding to the first image data and determines whether the first error detection code means an error occurs by the test device, while first image data is read from the storage device; wherein the test device records the first operating voltage as the erroneous operating voltage, when the first error detection code means the error occurs; and wherein the test device controls the power supply circuit to provide a second operating voltage to the image processing chip, when the first error detection code means that the error does not occur; wherein the test device receives a second error detection code corresponding to second image data and determining whether the second error detection code means the error occurs when second image is read from the storage device, when the first error detection code means that the error does not occur.

In view of above-mentioned embodiments, the image processing chip can be automatically and accurately detected. In such way, the conventional issue that the erroneous operating voltage could not be automatically and accurately detected can be improved.

These and other objectives of the present invention will no doubt become obvious to those of ordinary skill in the art after reading the following detailed description of the preferred embodiment that is illustrated in the various figures and drawings.

DETAILED DESCRIPTION

Several embodiments are provided in following descriptions to explain the concept of the present invention. Each component in following descriptions can be implemented by hardware (e.g. a device or a circuit) or hardware with software (e.g. a program installed to a processor). Besides, the method in following descriptions can be executed by programs stored in a non-transitory computer readable recording medium such as a hard disk, an optical disc or a memory. Besides, the term "first", "second", "third" in following descriptions are only for the purpose of distinguishing different one elements, and do not mean the sequence of the elements. For example, a first device and a second device only mean these devices can have the same structure but are different devices.

Figure 1:
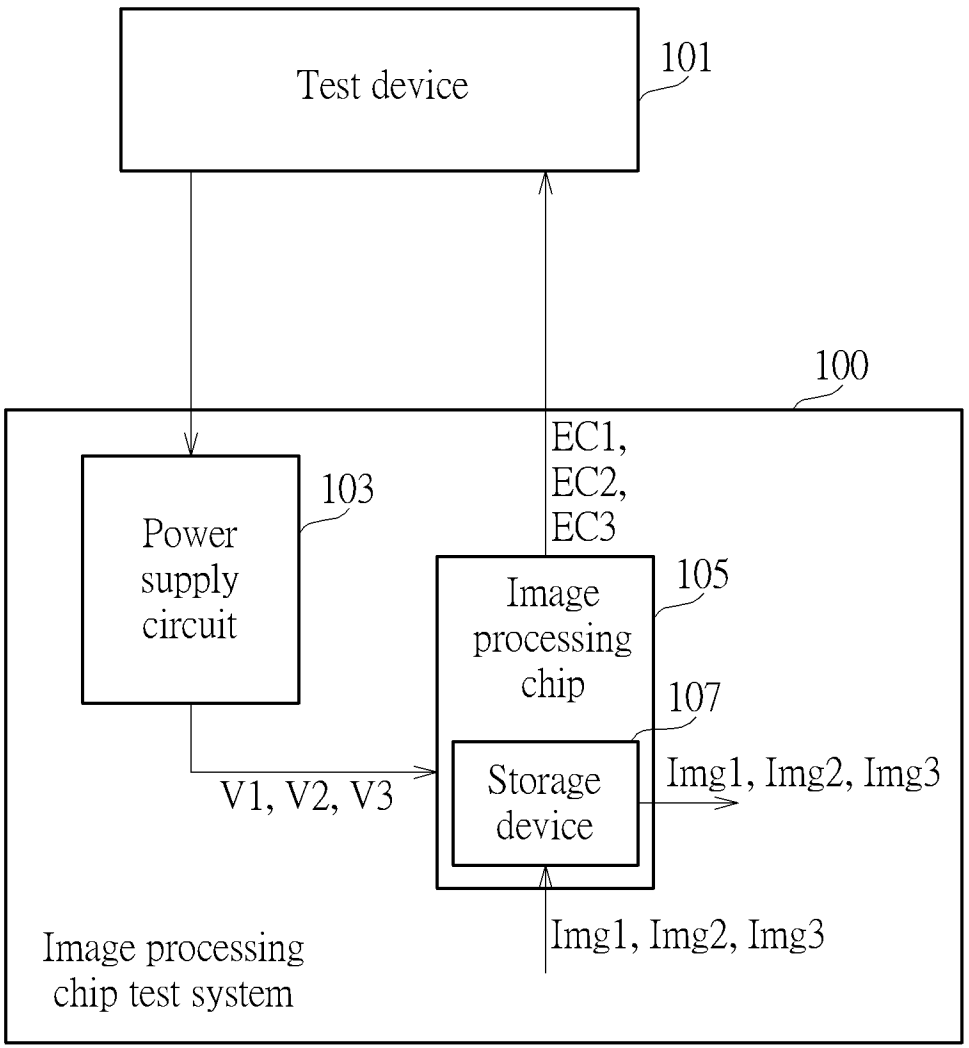
FIG. 1 is a block diagram illustrating an image processing chip test system using the image processing chip test method according to one embodiment of the present invention.

FIG. 1 is a block diagram illustrating an image processing chip test system using the image processing chip test method according to one embodiment of the present invention. AS shown in FIG. 1, the image processing chip test system 100 comprises a test device 101, a power supply circuit 103 and an image processing chip 105. The power supply circuit 103 and the image processing chip 105 may be located on the same circuit board and the image processing chip 105 comprises a storage device 107. The test device 101 is used to execute at least one program to perform the image processing chip test method provided by the present invention. According to the image processing chip test method provided by the present invention, the test device 101 controls the power supply circuit 103 to sequentially provide at least one operating voltage to the image processing chip 105. The test device 101 will receive an error detection code corresponding to the image data when the image data is read from the storage device 107. The test device 101 further determines whether the error detection code means an error occurs when the image data is read from the storage device 109. If the error detection code means that no error occurs, the power supply circuit 103 continues to provide the next operating voltage for testing. If the error detection code EC means that an error occurs, the current operating voltage is recorded as an erroneous operating voltage.

For example, as shown in FIG. 1, the test device 101 controls the power supply circuit 103 to provide a first operating voltage V1 to the image processing chip 105, which comprises a storage device 107. The first image data Img1 will be written to the storage device 107, and when the first image data Img1 is read from the storage device 107, the test device 101 will receive the first error detection code EC1 corresponding to the first image data Img1 and determines whether the first error detection code EC1 means that an error occurs. If the first error detection code EC1 means that an error occurs, the first operating voltage V1 is recorded as the erroneous operating voltage. If the first error detection code EC1 means that the error does not occur, a second operating voltage V2 is provided to the image processing chip 105, and second image data Img2 is written to the storage device 107. When reading the second image data Img2 from the storage device 107, the test device 101 receives the second error detection code EC2 corresponding to the second image data Img2 and determines whether the second error detection code EC2 means an error.

Similarly, if the second error detection code EC2 means that an error occurs, the second operating voltage V2 is recorded as an erroneous operating voltage. If the second error detection code EC2 means that the error does not occur, a third operating voltage V3 is provided to the image processing chip 105. Then the third image data Img3 will be stored in the storage device 107, and when the third image data Img3 is read from the storage device 107, the test device 101 will receive the third error detection code EC3 corresponding to the third image data Img3 and determines whether the third error detection code EC3 means an error. The foregoing operations of the first operating voltage V1, the second operating voltage V2, and the third operating voltage V3 may be repeated until a predetermined condition is satisfied. The predetermined condition may be that a predetermined number of erroneous operating voltages are detected (for example, one erroneous operating voltage or five erroneous operating voltages are detected). Alternatively, it may be repeated until the operating voltage reaches a predetermined number of times. For example, it may be preset to test 20 operating voltages V1-V20. Moreover, the aforementioned first image data Img1, second image data Img2, and third image data Img3 may comprise the same image content, or may comprise different image content.

In one embodiment, the third operating voltage V3 is lower than the second operating voltage V2, and the second operating voltage V2 is lower than the first operating voltage V1. That is to say, the operating voltages provided by the test device 101 to control the power supply circuit 103 gradually decrease. The previous operating voltage of the erroneous operating voltage firstly detected in this way is the lowest operating voltage at which the image processing chip 105 can operate. For example, the test device 101 sequentially provides the operating voltages V1, V2 . . . Vn to the image processing chip 105. The operating voltage V1 is the highest, and then the operating voltages V2 . . . Vn gradually decrease. None of the error detection codes corresponding to the operating voltages V1, V2 . . . Vn−1 mean an error, and the error detection codes corresponding to the operating voltage Vn mean an error. In this example, the operating voltage Vn is recorded as an erroneous operating voltage, and the operating voltage Vn−1 is recorded as the lowest operating voltage. In one embodiment, if the image processing chip 105 operates at the operating voltage Vn, there is an error, but the error is quite minor, and the operating voltage Vn can still be recorded as the lowest operating voltage.

In one embodiment, the third operating voltage V3 is higher than the second operating voltage V2, and the second operating voltage V2 is higher than the first operating voltage V1. In other words, the operating voltages provided by the test device 101 gradually increase, and the previous operating voltage of the erroneous operating voltage firstly detected is the maximum operating voltage that the image processing chip 105 can withstand. For example, the test device 101 sequentially provides the operating voltages V1, V2 . . . Vn to the image processing chip 105, and the operating voltage V1 is the lowest (which may be the aforementioned minimum operating voltage) and then the operating voltage V2 . . . Vn gradually increases. None of the error detection codes corresponding to the operating voltage V1 or V2 . . . Vn−1 mean that an error occurs, and the error detection codes corresponding to the operating voltage Vn mean that an error occurs. In this example, the operating voltage Vn is recorded as an erroneous operating voltage, and the operating voltage Vn−1 is recorded as the highest operating voltage. In one embodiment, if the image processing chip 105 operates at the operating voltage Vn, there is an error, but the error is quite minor, and the operating voltage Vn can still be recorded as the highest operating voltage.

The components shown in FIG. 1 may be implemented by various devices or circuits. The test device 101 can be a computer or any other device that can control the power supply circuit 103. In one embodiment, the storage device 107 is a double data rate (Double Data Rate, DDR) memory. The error detection codes may be various codes that can be used to confirm whether the data read by the storage device is correct or not. In one embodiment, the error detection codes are CRC (Cyclical Redundancy Check) codes. The test device 101 can obtain the reference error detection codes generated based on the image data before input, and then compare the error detection codes generated when the image data is read from the storage device 107 to determine whether the read image data has error or not. However, please note that the test device 101 may have different determination mechanisms corresponding to different error detection codes. Such changes should also fall in the scope of the present invention.

Figure 2:
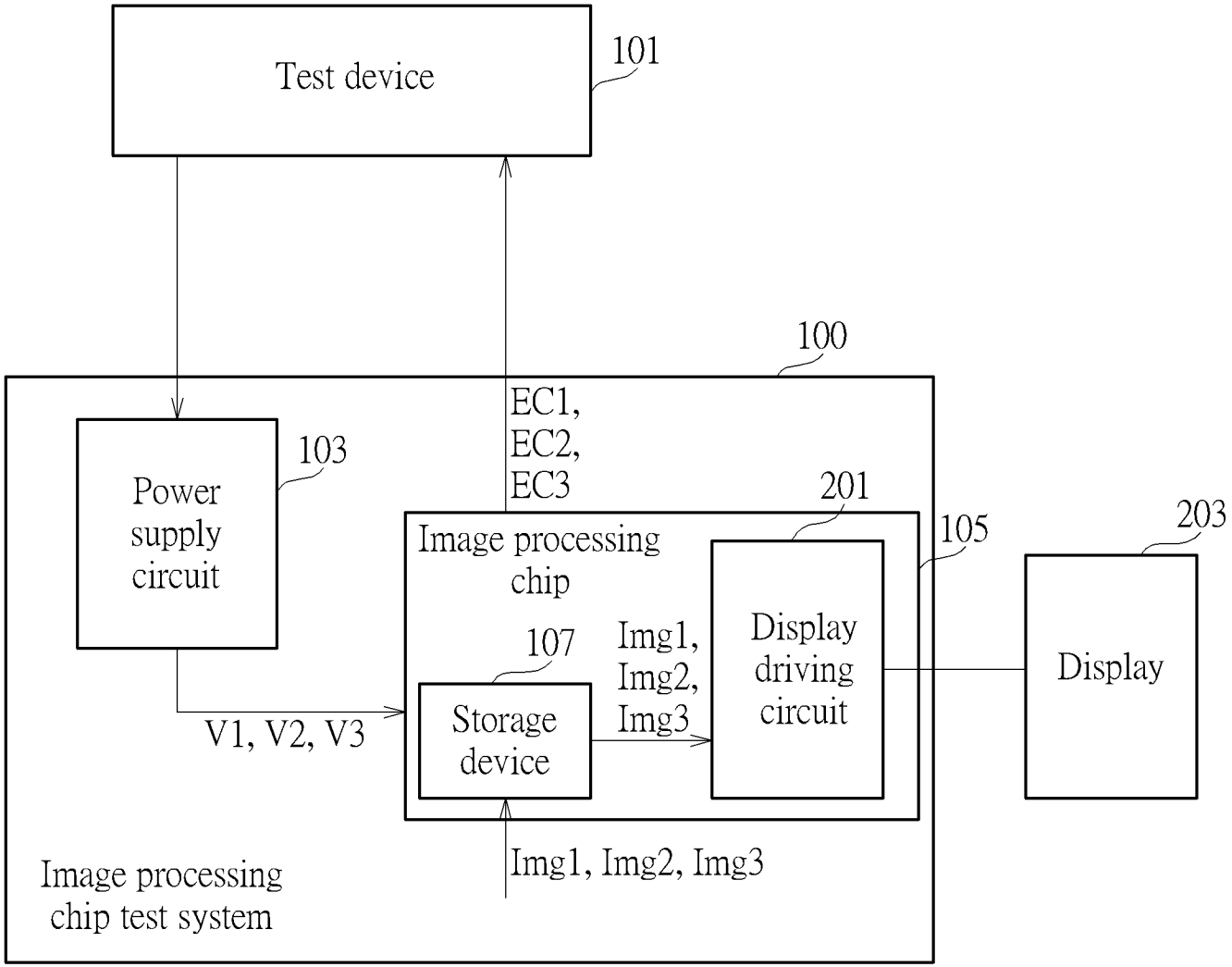
FIG. 2 is a block diagram illustrating an image processing chip test system using the image processing chip test method according to another embodiment of the present invention.
Figure 3:
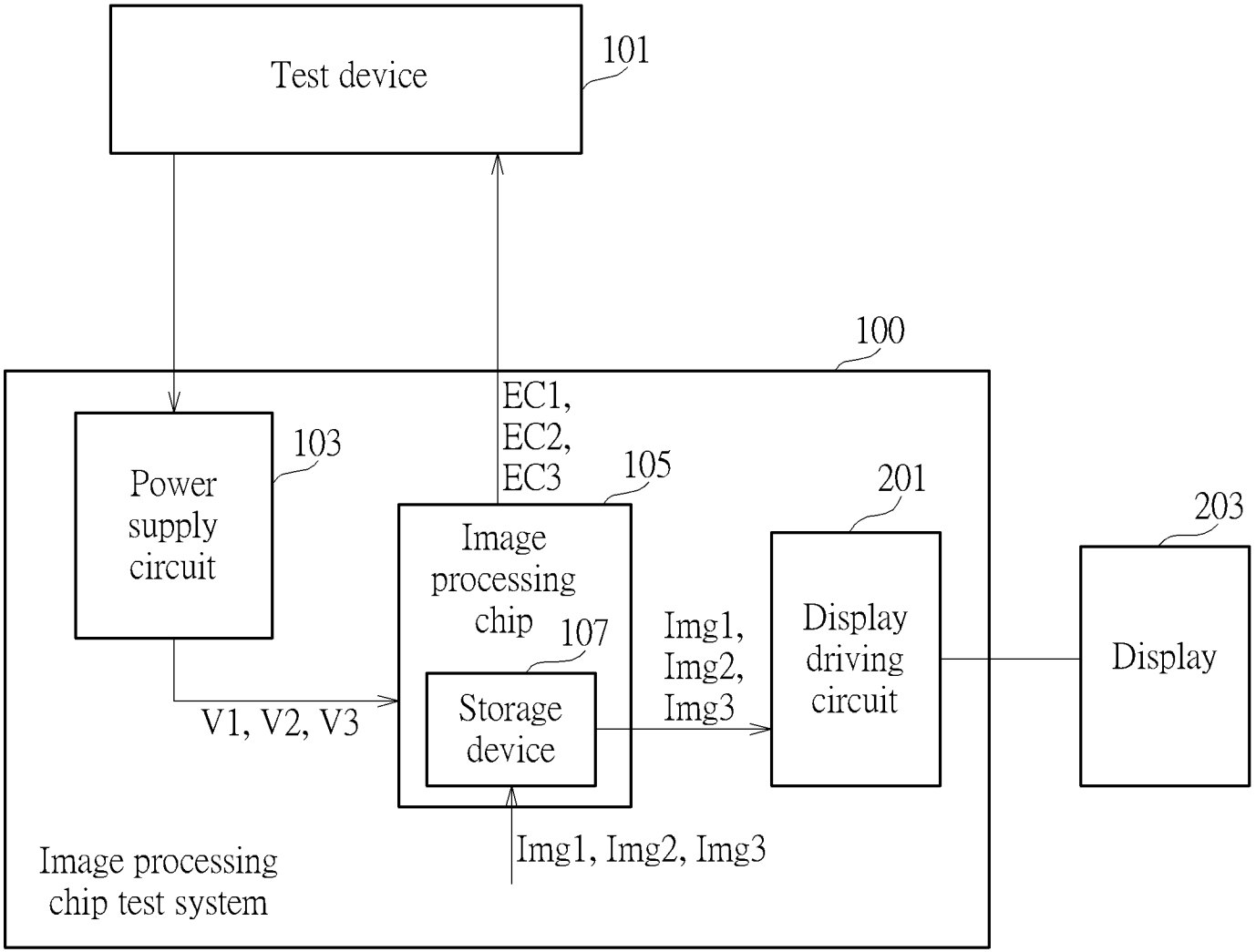
FIG. 3 is a block diagram illustrating an image processing chip test system using the image processing chip test method according to still another embodiment of the present invention.

FIG. 2 is a block diagram illustrating an image processing chip test system using the image processing chip test method according to another embodiment of the present invention. In this embodiment, the image processing chip 105 is coupled to a display 203. When the error detection code means that an error occurs, the display 203 displays a corresponding defected screen (for example, flashing or image string). In the foregoing descriptions, it is mentioned that if the image processing chip 105 operates at the operating voltage Vn, there is an error, but this error is quite minor and the operating voltage Vn can still be recorded as the lowest operating voltage. The minor error here may mean that the display 203 displays the corresponding defected screen, but the error is quite minor (for example, only one or two pixels) or the defected screen has only a very short time and does not affect the user's experience of enjoying the video. Please refer to FIG. 2 again. In the embodiment of FIG. 2, the image processing chip 105 further comprises a display driving circuit 201 coupled to the storage device 107. The display driving circuit 201 is coupled to the storage device 107 and the display 203 to control the display 203 to display the image data read from the storage device 107. The image processing chip 105 may further comprise other elements, such as a storage device control circuit. In addition, the display driving circuit 201 is not limited to be comprised in the image processing chip 105. As shown in FIG. 3, the display driving circuit 201 is a circuit independent from the image processing chip 105 and is not comprised in the image processing chip 105.

Figure 4:
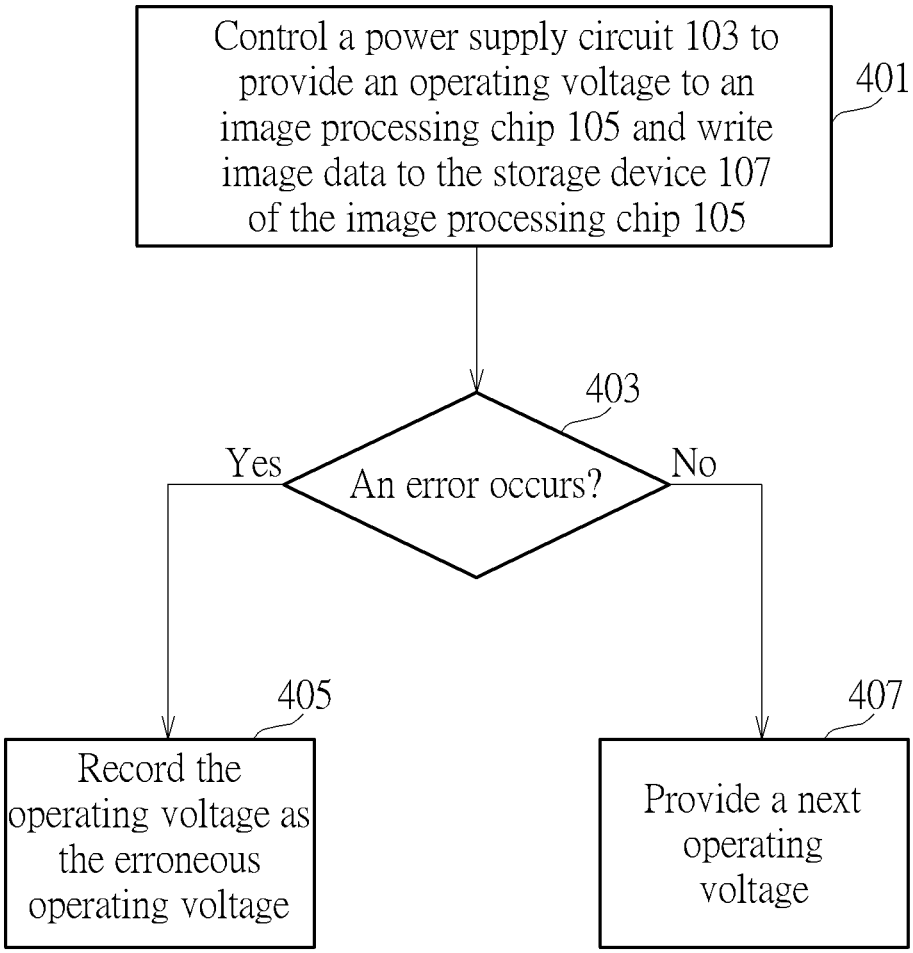
FIG. 4 is a flow chart illustrating an image processing chip test method according to one embodiment of the present invention.

FIG. 4 is a flow chart illustrating an image processing chip test method according to one embodiment of the present invention. The image processing chip test method can be performed while a test device executing at least one program and may comprise:

Step 401

Control a power supply circuit 103 to provide an operating voltage to an image processing chip 105 and write image data to the storage device 107 of the image processing chip 105.

Step 403

Determine whether the error detection codes mean an error occurs while reading the image data from the storage device 107. If an error occurs, go to step 405. If the error does not occur, go to step 407.

Step 405

Record the operating voltage as the erroneous operating voltage.

Step 407

Provide a next operating voltage and goes back to the step 401.

In view of above-mentioned embodiments, the image processing chip can be automatically and accurately detected. In such way, the conventional issue that the erroneous operating voltage could not be automatically and accurately detected can be improved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An image processing chip test method performed by executing at least one program on a test device, comprising:

controlling a power supply circuit to provide a first operating voltage to an image processing chip comprising at least one storage device;

writing first image data to the storage device;

receiving a first error detection code corresponding to the first image data and determining whether the first error detection code means an error occurs by the test device, while reading the first image data from the storage device;

recording the first operating voltage as the erroneous operating voltage, when the first error detection code means the error occurs; and providing a second operating voltage to the image processing chip, writing second image data to the storage device, reading the second image from the storage device, receiving a second error detection code corresponding to the second image data and determining whether the second error detection code means the error occurs, when the first error detection code means that the error does not occur.

2. The image processing chip test method of claim 1, wherein the second operating voltage is lower than the first operating voltage.

3. The image processing chip test method of claim 2, further comprising:

recording the second operating voltage as the erroneous operating voltage, when the second error detection code means the error occurs; and providing a third operating voltage to the image processing chip, writing third image data to the storage device, and reading the third image from the storage device, receiving a third error detection code corresponding to the third image data and determining whether the third error detection code means the error occurs, when the second error detection code means the error does not occur;

wherein the third operating voltage is lower than the second operating voltage.

4. The image processing chip test method of claim 1, wherein the second operating voltage is higher than the first operating voltage, and the first operating voltage is a lowest voltage at which the image processing chip can operate normally.

5. The image processing chip test method of claim 4, further comprising:

recording the second operating voltage as the erroneous operating voltage, when the second error detection code means the error occurs; and providing a third operating voltage to the image processing chip, writing third image data to the storage device, and reading the third image from the storage device, receiving a third error detection code corresponding to the third image data and determining whether the third error detection code means the error occurs, when the second error detection code means the error does not occur;

wherein the third operating voltage is higher than the second operating voltage.

6. The image processing chip test method of claim 1, wherein the first error detection code is a CRC (cyclic redundancy check) code.

7. The image processing chip test method of claim 6, wherein the storage device is a DDR (double data rate) memory.

8. The image processing chip test method of claim 1, wherein the image processing chip further comprises a display driving circuit coupled to the storage device, the display driving circuit is coupled to a display to control the display to display image data read from the storage device;

wherein the display displays a corresponding defected screen when the error detection code means the error occurs.

9. The image processing chip test method of claim 1, further comprising a display driving circuit independent from the image processing chip and coupled to the storage device, the display driving circuit is coupled to a display to control the display to display image data read by the storage device;

wherein the display displays a corresponding defected screen when the error detection code means the error occurs.

10. The image processing chip test method of claim 1, wherein the first image data and the second image data comprise identical image content.

11. An image processing chip test system, comprising:

a test device;

a power supply circuit; and an image processing chip, comprising at least one storage device;

wherein the test device controls a power supply circuit to provide a first operating voltage to an image processing chip;

wherein the test device receives a first error detection code corresponding to the first image data and determines whether the first error detection code means an error occurs by the test device, while first image data is read from the storage device;

wherein the test device records the first operating voltage as the erroneous operating voltage, when the first error detection code means the error occurs;

wherein the test device controls the power supply circuit to provide a second operating voltage to the image processing chip, when the first error detection code means that the error does not occur; and wherein the test device receives a second error detection code corresponding to second image data and determining whether the second error detection code means the error occurs when second image is read from the storage device, when the first error detection code means that the error does not occur.

12. The image processing chip test system of claim 11, wherein the second operating voltage is lower than the first operating voltage.

13. The image processing chip test system of claim 12, further comprising:

wherein the test device records the second operating voltage as the erroneous operating voltage, when the second error detection code means the error occurs; and wherein the test device controls the power supply circuit to provide a third operating voltage to the image processing chip, when the second error detection code means that the error does not occur;

wherein the test device receives a third error detection code corresponding to third image data and determines whether the third error detection code means the error occurs when third image is read from the storage device, when the second error detection code means that the error does not occur;

wherein the third operating voltage is lower than the second operating voltage.

14. The image processing chip test system of claim 11, wherein the second operating voltage is higher than the first operating voltage, and the first operating voltage is a lowest voltage at which the image processing chip can operate normally.

15. The image processing chip test system of claim 14, further comprising:

wherein the test device records the second operating voltage as the erroneous operating voltage, when the second error detection code means the error occurs; and wherein the test device controls the power supply circuit to provide a third operating voltage to the image processing chip, when the second error detection code means that the error does not occur;

wherein the test device receives a third error detection code corresponding to third image data and determines whether the third error detection code means the error occurs when third image is read from the storage device, when the second error detection code means that the error does not occur;

wherein the third operating voltage is higher than the second operating voltage.

16. The image processing chip test system of claim 11, wherein the first error detection code is a CRC (cyclic redundancy check) code.

17. The image processing chip test system of claim 16, wherein the storage device is a DDR (double data rate) memory.

18. The image processing chip test system of claim 11, wherein the image processing chip further comprises a display driving circuit coupled to the storage device, the display driving circuit is coupled to a display to control the display to display image data read from the storage device;

wherein the display displays a corresponding defected screen when the error detection code means the error occurs.

19. The image processing chip test system of claim 11, further comprising a display driving circuit independent from the image processing chip and coupled to the storage device, the display driving circuit is coupled to a display to control the display to display image data read by the storage device;

wherein the display displays a corresponding defected screen when the error detection code means the error occurs.

20. The image processing chip test system of claim 11, wherein the first image data and the second image data comprise identical image content.

* * * * *